United States Patent [19]

Huynh

[11] Patent Number: 4,773,966

[45] Date of Patent: Sep. 27, 1988

[54] OXIDATIVE DEGRADATION OF LIGNIN WITH INORGANIC METAL COMPLEXES

[75] Inventor: Van-Ba Huynh, Wayzata, Minn.

[73] Assignee: Regents of the University of Minnesota, Minneapolis, Minn.

[21] Appl. No.: 913,024

[22] Filed: Sep. 29, 1986

[51] Int. Cl.[4] ..... D21C 3/00

[52] U.S. Cl. ..... 162/78; 162/79; 530/500; 530/506

[58] Field of Search ..... 530/500, 506; 162/78, 162/79

[56] References Cited

U.S. PATENT DOCUMENTS

| | | | |
|---|---|---|---|
| 1,768,823 | 7/1930 | Bradley et al. | 162/78 |
| 2,610,954 | 9/1952 | Raff et al. | 530/500 X |
| 2,858,271 | 10/1958 | Byrd | 530/500 X |
| 3,071,570 | 1/1963 | Marton et al. | 530/500 |
| 3,476,740 | 11/1969 | Markham et al. | 530/500 |
| 4,404,061 | 9/1983 | Cael | 162/78 X |
| 4,427,490 | 1/1984 | Eckert | 162/78 |
| 4,475,984 | 10/1984 | Cael | 162/78 X |

OTHER PUBLICATIONS

Kirk & Chang (Enzyme Microb. Technol., 1981, 3: 189–196).

Tien & Kirk (Proc. Natl. Acad. Sci., 1984, 81: 2280–2284).

*Primary Examiner*—Earl Nielsen

*Attorney, Agent, or Firm*—Merchant, Gould, Smith, Edell, Welter & Schmidt

[57] ABSTRACT

A method is disclosed to degrade lignin comprising reacting the lignin in a liquid medium under aerobic conditions with an amount of persulfate anion and a transition metal cation effective to catalyze the oxidative degradation of the lignin.

18 Claims, No Drawings

OXIDATIVE DEGRADATION OF LIGNIN WITH INORGANIC METAL COMPLEXES

BACKGROUND OF THE INVENTION

Pulp is the raw material for the production of paper, paperboard, fiberboard and the like. In purified form, it is a source of cellulose for rayon, cellulose esters and other cellulosic products. Pulp is obtained from plant fiber such as wood, straw, bamboo and sugarcane residues. Wood is the source of 99% of the pulp fiber produced in the United States.

Dry wood consists of 40 to 50 percent cellulose, 15 to 25 percent other polysaccharides known as hemicelluloses, 20–30 percent lignin, a biopolymer which acts as a matrix for the cellulose fibers, and 5 percent of other substances such as mineral salts, sugars, fat, resin and protein. Lignin is composed primarily of methoxylated phenyl propane monomeric units interconnected by a variety of stable C—C and ether linkages. The lignin of conifers is apparently an oxidative polymerization product of coniferyl alcohol [3-(3′-methoxy-4′-hydroxyphenyl)allyl alcohol], while the lignin of deciduous trees appears to be derived from coniferyl alcohol and sinapyl alcohol [3-(3′,5′-dimethoxy-4′-hydroxyphenyl)allyl alcohol].

Wood pulp is manufactured by dissolving the lignin with hot solutions of (1) sodium hydroxide, (2) calcium, magnesium, or ammonium bisulfite, or (3) a mixture of sodium hydroxide and sodium sulfide (made from lime and reduced sodium sulfate). The products, known as soda pulp, sulfite pulp or sulfate (kraft) pulp, respectively, consist of impure cellulose.

Under acid or alkaline pulping conditions, condensation ractions take place homolytically within the lignin polymer and very likely occur between lignin and carbohydrates such as hemicelluloses. Formaldehyde is also generated from the lignin residues in the presence of sodium hydroxide which can cause condensation and cross-linking of the phenylpropyl moieties. These reactions are undesirable in delignification. Chemical pulping processes are often conducted at high temperatures and pressures. These operating parameters are energy intensive and require costly equipment. Furthermore, kraft pulping yields volatile malodorous sulfur compounds such as hydrogen sulfide, methyl mercaptan and dimethyl disulfide which are hazardous to human health and to the environment.

Bleaching processes may also be applied to the crude pulp, in order to complete the delignification process and remove pitch. The bleaching reagents are mostly oxidative. One bleaching method involves an initial chlorination of the lignin under acidic conditions, followed by alkaline hydrolysis and extraction of the chlorinated lignin. Further brightening of the pulp is accomplished with chlorine dioxide. Bleach plant effluents contain polymeric lignin degradation products which are highly colored, along with corrosive chloride ion. These effluents are resistant to current bacteria-based biological wastewater treatment processes and must be decolorized via expensive filtration or precipitation steps prior to their discharge into the environment.

Therefore, a need exists for methods to delignify plant fiber or pulp which minimize the undesirable condensation reactions caused by the presently-employed chemical pulping and bleaching methods. A further need exists for lignin-degrading pulp bleaching methods which eliminate the damage to cellulosic fibers which can be caused by chlorinebased oxidizing agents. A further need exists for methods to degrade lignin which are energy efficient, and which eliminate the environmental release of polluting lignin-derived chlorinated aromatic compounds.

SUMMARY OF THE INVENTION

The present invention is directed to a method to degrade lignin comprising reacting the lignin in a liquid medium under aerobic conditions with an amount of persulfate anion ($S_2O_8^{-2}$) and a transition metal ion which are effective to catalyze the oxidative degradation of the lignin.

In the course of the reaction, the lignin is broken down into lower molecular weight molecules, preferably those which are water-soluble or readily water-dispersible, such as simple aromatic acids and alcohols. Thus, when a substrate comprising lignin, such as plant fiber or pulp, is supplied to the reaction mixture, delignification can be accomplished without the formation of intractable lignincontaining condensation products and/or chlorinated aromatic compounds. The need to use hazardous caustic or chlorinated reagents in the pulping or bleaching process can also be reduced or eliminated by the present method. Since the persulfate-metal ion system catalyzes the reaction between oxygen and the lignin, the environmental impact of the residual sulfur compounds or metal values in the reaction medium post-reaction can be minimized.

DETAILED DESCRIPTION OF THE INVENTION

Peroxydisulfate is one of the strongest oxidizing agents, and its ability to oxidize aromatic compounds is believed to be due to its major decomposition product $SO_4$—. The reaction of $SO_4$— with aromatic compounds to yield aryl cation radicals can occur as a direct one equivalent oxidation, followed by sidechain cleavage or by proton loss from the side chains, to yield benzylic radicals, or benzyl cations, respectively. Preferably, the persulfate anion is supplied to the reaction medium as ammonium persulfate, an alkali metal persulfate such as $K_2S_2O_8$ or $Na_2S_2O_8$, or mixtures thereof. These salts, also known as peroxydisulfates or peroxodisulfates, are commercially-available, e.g., from Alfa Products, Danvers, MA or Mallinckrodt Chemical Co., St. Louis, MO.

The transition metal ion is preferably selected from the cations of group IB, IIIb, IVB, VB, VIB, VIIB or VIII of the periodic table. Preferably, the metal ion is selected from the group consisting of $Cu^{+2}$, $Co^{+2}$, $Ag^{+1}$, $Fe^{+2}$, $Mn^{+2}$ and $Ni^{+2}$, and is supplied to the reaction mixture in the form of a water-soluble inorganic or organic salt such as the sulfate, chloride, bromide, iodide, acetate, oxalate, phosphate and the like. The transition metal may catalyze the formation of the $SO_4$— species and may also directly act as a radical scavenger, thus avoiding undesirable condensation reactions.

The amount of the persulfate salt and transition metal salt which are effective to pulp, bleach or otherwise delignify a given amount of substrate will vary widely, and will depend upon such factors as the nature of the substrate and the lignin therein, reaction temperature and time and the dissolved oxygen concentration conditions of the medium. The present method can be conducted on a small scale and the medium analyzed for lignin degradation products as disclosed hereinbelow. Therefore, effective operating parameters for the present method can readily be attained by one of skill in the art. The reaction is conducted under aerobic conditions to minimize the free radical coupling reactions which would be expected to occur in the absence of oxygen. The presence of oxygen also enhances the formation of watersoluble or water-dispersable end products, such as carboxylic acids, formates and phenols.

Oxygenation can be accomplished by agitation of the reaction medium under ambient conditions or by supplying oxygen to the medium, e.g., via bubblers or by pressurizing the headspace above the reaction vessel.

The lignin degradation reaction is preferably carried out in a liquid medium at neutral or acidic pH, e.g., at a pH no higher than about 7.5, e.g., at about 2–7.0. Preferably, the reaction medium will comprise a major proportion of water. However, organic solvents, preferably those which are water-miscible, may be employed in amounts effective to solubilize the lignin degradation products. Such solvents include acetic acid and acctonitrile. Since lignin and lignin-containing substrates yield products due to acid-catalyzed rearrangements which are undesirable, the pH of the medium is preferably maintained at a weakly acidic pH of about 3–6.5, or near neutrality (pH 6.5–7.5) by the use of an appropriate buffer system. For example, the sodium acetate/acetic acid buffer system is particularly useful to neutralize sulfate anions formed during the reaction.

In the practice of the present invention, processed pulp or fragmented or comminuted plant fiber such as wood chips is stirred or slurried in water and the pH adjusted by the addition of acids or buffering agents. The appropriate amounts of the persulfate and the metal salt are then added and the reaction stirred with optional oxygenation and heating, e.g., to about 50°–100° C., until the pulping or bleaching reaction has been carried out to the desired extent. Aqueous effluents from chemical pulp bleaching processes can be treated in like manner to degrade the lignin residues therein.

The invention will be further described by reference to the following detailed examples.

EXAMPLE I

OXIDATION OF LIGNIN MODEL COMPOUNDS

A. Materials and Methods

Ammonium persulfate ((NH4)2S2O8) was obtained from Mallinckrodt Chemical Co. (St. Louis, MO). Cupric acetate monohydrate (Cu(OAc)2. H2O) was obtained from Allied Chemical Co., Morristown, NJ. Dihydroanisoin was prepared by the reduction of anisoin (Aldrich Chemical Co., Milwaukee, WI) with sodium borohydride by the procedure of M. Shimada et al., *Arch. Microbiol.*, 134, 299 (1983), the disclosure of which is incorporated by reference herein. Veratryl alcohol was obtained from Aldrich Chemical Co. Veratryl-glycerol-$\beta$-guaiacyl ether (1-[3',4'-dimethoxyphenyl]-2[2'-methoxyphenoxy]-propan-1,3-diol) was synthesized as disclosed by S. Hosoya et al., *Mokuzai Gakkaishi*, 26, 118 (1980), the disclosure of which is incorporated by reference herein. Product separation and structural analysis were accomplished by gas-chromatography/mass spectroscopy (GC/MS) procedures as disclosed by V.-B. Huynh et al., *Arch. Biochem. Biophys.*, 250, 186 (1986). The reaction medium was extracted with chloroform at pH 2–3. Compounds were analyzed either in their free forms or after conversion to acetates (treatment with pyridine-acetic anhydride, 1:1), methyl esters (diazomethane derivatization), or trimethylsilyl derivatives (TMS; derivatization with bis(trimethylsilyl)triflouroacetamide in pyridine, 1:1). For GC/MS analyses, the instruments and columns used were as disclosed in V.-B. Huynh et al., Tappi, 68, 98 (1985), the disclosure of which is incorporated by reference herein.

For gas-liquid chromatographic (GLC) analyses, the following column temperature program was employed: 120° C. for 1 min, then rising to 285° C. at 8° C. per min and holding at 285° C. for 5 min. Qualitative and preparative thin-layer chromatography (TLC) were performed using precoated silica gel plates (Eastman Kodak Company, Rochester, NY, 100 $\mu$m thickness; Analtech, Inc., Newark, Del., 1 mm thickness). A mobile phase of chloroform:n-hexane:acetone:acetic acid (5:5:1:0.2) was employed. Organic compounds were visualized under a 254 nm uv light, or by spraying with 2,4-dinitrophenylhydrazine or p-anisidine in dilute HC1.

B. Lignin Model Compounds

The wood-decaying white rot fungus *Phanerochaete chrysosporium* can at least partially degrade naturally-occurring lignins via multiple extracellular enzymes or "ligninases". These enzymes have been disclosed to catalyze oxidations in the alkyl side chains of lignin-related compounds: $C_\alpha$- $C_\beta$cleavage in lignin model compounds of the type aryl-$C_\alpha$HOH-$C_\beta$HR-$C_{60}H_2$OH (R=-aryl or -O-aryl), oxidation of benzyl alcohols to aldehydes or ketones, intradiol cleavage of phenyl glycol structures and hydroxylation of benzylic methylene groups. See, for example, T. K. Kirk et al., *Enzyme Microb. Technol.*, 3, 189 (1981) and M. Tien et al., *Proc. Natl. Acad. Sci. USA*, 81, 2280 (1984). Therefore, dihydroanisoin (I), veratrylglycerol-$\beta$-guaicyl ether (II) and veratryl alcohol (III) were employed as lignin model compounds in the examples herein, since they have been demonstrated to be good substrates for ligninolytic cultures of *P. chrysosporium* as well as for various ligninases. See also, M. Tien et al., *Science*, 221, 661 (1983); J. K. Glenn et al., *Biochem. Biophys. Res. Comm.* 114, 1077 (1983) and M. Shimada et al., *Arch. Microbiol.*, 134, 299 (1983).

C. Reaction of Dihydroanisoin with $S_2O_8-{}^2Cu(II)$

Dihydroanisoin (I) (1 mmol), ammonium persulfate ((NH4)2S2O8, 2 mmol) and cupric acetate monohydrate (Cu(OAc)2. H2O, 1 mmol) in a solution of 10 ml acetic acid and 2 ml water were placed in a 25 ml round-bottomed flask and the reaction mixture refluxed for 90 min under aerobic conditions. The reaction mixture was poured onto about 50 ml of ice and the resultant mixture extracted with chloroform. The chloroform extract was analyzed by gas-liquid chromatography (GLC), thin-layer chromatography (TLC) and GC-MS.

More than 90% of the dihydroanisoin substrate was oxidized. The major reaction products were identified as p-anisaldehyde (30–35%), 4,4'-dimethoxybenzil (32–37%), 1-[4'-methoxyphenyl]-4-methoxyacetophenone (15–17%), p-anisic acid (17–20%) and anisoin (5–7%). The remaining products, 4-methoxylphenyl formate, 4-methoxyphenol and phenylacetophenone, were present at less than 5% of the reaction product, respectively.

The formation of p-anisaldehyde is probably the result of the cleavage of the diketo bond of anisoin, an intermediate in the oxidation of dihydroanisoin, since the oxidation of anisoin under the same reaction conditions yielded about 30 of p-anisaldehyde and about 10% of anisic acid.

Refluxing compound I in the absence of oxidants afforded only phenylacetophenone and diphenylacetaldehyde, unoxidized products which are formed by acid catalyzed carbonium ion rearrangements.

D. Oxidation of Veratrylglycerol-β-guaiacyl Ether with $S_2O_8^{-2}$Cu(II)

The oxidation of veratrylglycerol-β-guaiacyl ether (II) with $S_2O_8^{-2}$Cu(II) in accord with the procedure of Example I(C) yielded veratraldehyde (20–25%), and guaiacol (about 10%), along with 20% of recovered II and trace amounts of is alpha-keto derivative, and the mono- and diacetate of II.

E. Oxidation of Veratryl Alcohol with $S_2O_8^{-2}$Cu(II)

The oxidation of veratryl alcohol in accord with the procedure of Example I(C) yielded veratraldehyde (20%), veratryl acetate (45%), a trace of bis-[3,4-dimethoxyphenyl] methane and 20% of a product tentatively identified as [2'-acetoxymethylenyl-4',5'-dimethoxyphenyl]-[3',4'-dimethoxyphenyl]-methane. In this example, acetate formation probably results from acid catalysis yielding benzyl cation which can initiate an electrophilic attack on acetate.

Model compounds I and II possess substructural features of lignin. Furthermore, model compound III is an important marker which is used to assay "ligninases" and is a common metabolite of *P. chysosporium* [M. Tien et al., *Science,* 221, 661 (1983)]. Examples IC-E demonstrate that the oxidation of these compounds with a persulfate-metal ion system yields products similar to those obtained using "ligninases", and it is likely that the reaction pathways are similar. In accord with these experiments, preliminary studies indicate that wood pulp can be bleached employing the method of the present invention.

The invention has been described with reference to various specific and preferred embodiments and techniques. However, it should be understood that many variations and modifications may be made while remaining within the spirit and scope of the invention.

What is claimed is:

1. A method to degrade lignin comprising reacting the lignin in a liquid medium under aerobic conditions with an amount of $S_2O_8^{-2}$ and a transition metal ion effective to catalyze the oxidative degradation of the lignin, without the substantial formation of lignin condensation products.

2. The method of claim 1 wherein the medium comprises a major proportion of water.

3. The method of claim 1 wherein the pH of the aqueous medium is no higher than about 7.5.

4. The method of claim 2 wherein the pH of the aqueous medium is about 2–7.5.

5. The method of claim 1 wherein the aqueous medium comprises an alkali metal persulfate, ammonium persulfate or mixtures thereof.

6. The method of claim 1 wherein the metal ion is selected from the group consisting of $Cu^{+2}$, $Co^{+2}$, $Ag^{+1}$, $Fe^{+2}$, $Mn^{+2}$ and $Ni^{+2}$.

7. The method of claim 6 wherein the metal ion is $Cu^{+2}$.

8. The method of claim 1 wherein the reaction is carried out at about 50°–100° C.

9. The method of claim 1 wherein the lignin is present in plant fiber.

10. The method of claim 1 wherein the lignin is present in pulp.

11. A method to bleach wood pulp comprising delignifying the wood pulp by reacting the pulp in a liquid medium under aerobic conditions with an amount of $S_2O_8^{-2}$ and a transition metal ion effective to catalyze the oxidative degradation of lignin in the pulp.

12. The method of claim 11 wherein the medium comprises a major proportion of water.

13. The method of claim 11 wherein the pH of the aqueous medium is no higher than about 7.5.

14. The method of claim 12 wherein the pH of the aqueous medium is about 2–7.5.

15. The method of claim 11 wherein the aqueous medium comprises an alkali metal persulfate, ammonium persulfate or mixtures thereof.

16. The method of claim 11 wherein the metal ion is selected from the group consisting of $Cu^{+2}$, $Co^{+2}$, $Ag^{+1}$, $Fe^{+2}$, $Mn^{+2}$ and $Ni^{+2}$.

17. The method of claim 16 wherein the metal ion is $Cu^{+2}$.

18. The method of claim 11 wherein the reaction is carried out at about 50°–100° C.

* * * * *

UNITED STATES PATENT AND TRADEMARK OFFICE

CERTIFICATE OF CORRECTION

PATENT NO. : 4,773,966

DATED : September 27, 1988

INVENTOR(S) : Van-Ba Huynh

It is certified that error appears in the above-identified patent and that said Letters Patent is hereby corrected as shown below:

At column 1, line 35, for "ractions" read --reactions--.

At column 2, line 1, for "chlorinebased" read --chlorine-based--.

At column 2, line 22, for "lignincontaining" read --lignin-containing--.

At column 2, line 37, for "$SO_4$-. The reaction of $SO_4^{\bar{\cdot}}$ with" read --$SO_4^{\bar{\cdot}}$. The reaction of $SO_4^{\bar{\cdot}}$ with--.

At column 2, line 50, for "IIIb" read --IIIB--.

At column 3, line 8, for "watersoluble" read --water-soluble--.

At column 3, line 47, for "((NH4)2S2O8)" read --$((NH_4)_2S_2O_8)$--.

At column 3, line 49, for "(Cu(OAc)2. H2O)" read --$(Cu(OAc)_2 \cdot H_2O)$--.

At column 3, line 58, for "phenyl]-2[" read --phenyl]-2-[--.

At column 4, line 49, for "((NH4)2S2O8" read --$(NH_4)_2S_2O_8$--.

UNITED STATES PATENT AND TRADEMARK OFFICE

CERTIFICATE OF CORRECTION

PATENT NO. : 4,773,966

DATED : September 27, 1988

INVENTOR(S) : Van-Ba Huynh

It is certified that error appears in the above-identified patent and that said Letters Patent is hereby corrected as shown below:

At column 4, line 50, for "(Cu(OAc)2. H2O" read --$(Cu(OAc)_2 \cdot H_2O$--.

Signed and Sealed this

Twenty-fourth Day of October, 1989

*Attest:*

DONALD J. QUIGG

*Attesting Officer*

*Commissioner of Patents and Trademarks*